United States Patent [19]

Mevenkamp

[11] Patent Number: 4,869,315

[45] Date of Patent: Sep. 26, 1989

[54] DEVICE FOR COOLING THICK WALL MEMBERS

[75] Inventor: Paul Mevenkamp, Dortmund, Fed. Rep. of Germany

[73] Assignee: Uhde GmbH, Dortmund, Fed. Rep. of Germany

[21] Appl. No.: 626,738

[22] Filed: Jul. 2, 1984

[30] Foreign Application Priority Data

Jul. 1, 1983 [DE] Fed. Rep. of Germany ..... 3323781

[51] Int. Cl.[4] ..... F28D 7/12

[52] U.S. Cl. ..... 165/142; 122/6 A

[58] Field of Search ..... 165/134 R, 142; 122/6 A, 6 B

[56] References Cited

U.S. PATENT DOCUMENTS

| | | | |
|---|---|---|---|
| 1,796,284 | 3/1931 | Davy | 122/6 A |
| 2,252,606 | 8/1941 | Wick, Jr. | 122/6 B |
| 2,388,587 | 11/1945 | Wilson | 165/142 X |
| 4,209,129 | 6/1980 | Haas et al. | 165/142 X |
| 4,210,101 | 7/1980 | Touze | 165/142 X |
| 4,410,999 | 10/1983 | Wabersich et al. | 122/6 A X |
| 4,437,651 | 3/1984 | Cordier et al. | 122/6 B X |
| 4,479,535 | 10/1984 | Echego et al. | 165/134 R X |

FOREIGN PATENT DOCUMENTS

| | | | |
|---|---|---|---|
| 1291847 | 10/1972 | United Kingdom | 165/134 R |
| 2073387 | 10/1981 | United Kingdom | 122/6 B |

*Primary Examiner*—Ira S. Lazarus
*Assistant Examiner*—Peggy Neils
*Attorney, Agent, or Firm*—Toren, McGeady & Associates

[57] ABSTRACT

A device is provided for direct cooling of thick essentially horizontal wall members which are charged with different temperatures and possibly different pressures on their upper and lower sides, such as for cooling a heat exchanger tube sheet. Cooling of the wall member or component from the "cold side" is afford by closed end bores formed in the wall member which bores are open on the "cold side" and closed on the "hot side". Each closed end bore has a tube projecting from the "cold side" of the wall member and extending into the bore with its end within the bore located adjacent the closed end of the bore. The diameter of the tube is smaller than the diameter of the bore so that flow through the tube into the bore can reverse direction at the closed end and flow through the space between the tube and the bore.

5 Claims, 2 Drawing Sheets

DEVICE FOR COOLING THICK WALL MEMBERS

SUMMARY OF THE INVENTION

The present invention is directed to a device for cooling essentially horizontal thick wall members or components which are charged on their upper and lower surfaces with different temperatures and possibly different pressures. In particular, the device can be used for cooling heat exchanger tube sheets.

As an example, heat exchanger tube sheets charged on opposite surfaces with $NH_3$ converter recycle gas and with water are generally exposed to very different stresses on the colder and warmer sides. It has been proposed to reduce such stresses by lowering the temperature on both sides or by applying special measures for reducing the chemical attack exerted by aggressive fluids. In the German Offenlegungsschrift No. 30 22 480 special guidance of the flue gas is described for effecting temperature compensation. This known method yields very good results, especially in this particular field of application.

The primary object of the present invention is to provide a special design for the direct cooling of essentially horizontal thick wall members, particularly where there is extensive temperature charging of the wall member from the "cold side". In accordance with the present invention, closed bores are provided in the device extending between the opposite sides, for example in a tube sheet, where the bores extend from the upper colder side toward the lower warmer side and with a tube projecting into the bore from the upper colder side so that it projects from the colder side. The tube extends into the bore to a point adjacent the closed end. The diameter of the tube is smaller than the diameter of the bore. Based on the present invention, the closed bores afford an enlargement of the "cold" surface of the '; wall member. The tubes of smaller diameter projecting into the bores ensure, if the "cold" side of the wall member is charged with cooling water, that the water is sucked into the bores and is subsequently discharged through the tubes protruding beyond the colder side so that an additional cooling effect is obtained.

Various types of closed bores may be used. In one embodiment of the present invention, the length of the closed bore is less than the thickness of the wall member, for instance, a tube sheet, so that a blind bore is provided in the wall member. Alternatively, a continuous bore can be provided through the wall member and closed on the warmer side by a plug or the like.

In another embodiment of the invention, a continuous bore through the wall member can be provided and subsequently closed with a cap projecting slightly outwardly from the warmer side. This embodiment even allows the use of caps which project considerable distance beyond the "hot" surface. If, for instance the "hot" side is charged with flue gas, the arrangement of the cap projecting inwardly into the flue gas stream allows the cooling water in the gap to be vaporized and the vapor bubbles to rise toward the colder side so that a "natural circulation" of the cooling water through the tube and bore is provided. Although such an effect can be achieved with other bore designs, this arrangement affords a particularly efficient utilization.

For optimum circulation of the cooling medium through the bores, in still another embodiment of the present invention, the web or ring is positioned on the colder side forming an extension of the bore with the tube located in the bore projecting outwardly beyond the ring.

In still another embodiment of the present invention, the inlet and outlet openings for the cooling medium have been equipped with guiding elements. The cooling water inlet and the water vapor outlet can be arranged so that an optimum cooling water circulation is obtained. As mentioned above, the present invention is especially directed to a device for cooling heat exchanger tube sheets.

The invention can be utilized in a tube sheet provided with a plurality of bores for receiving heat exchanger tubes. The tube sheet is characterized in that certain of the bores are equipped with a cooling device having one or more features of the invention as set forth above, for instance, each fourth bore can be formed as a blind bore, as a continuous bore provided with a plug, or as a continuous bore provided with a projecting cap, with all such bores equipped with the tube extending into the bore to adjacent its closed end.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
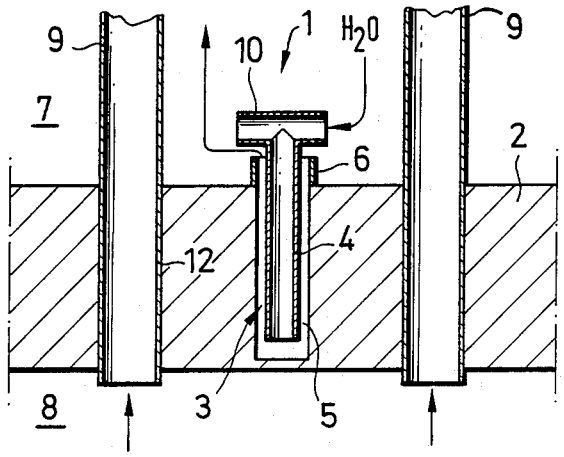
FIGS. 1 and 2 are sectional views of two typical embodiments of the device incorporating the present invention and used for cooling heat exchanger tube sheets.

In FIG. 1 a device 1 embodying the present invention is installed in a horizontally arranged heat exchanger sheet 2 having a closed or blind bore 3 formed into the tube sheet from the upper or cold side 7. A tube 4 extends downwardly into the blind bore 3 and it has a smaller diameter than the bore.

A ring or web 6 is positioned on the colder side 7 of the tube sheet 2 so that it forms an elongation of the bore 3. The lower side of the wall member or tube sheet 2 forms the warmer side 8. The ring 6 forms a guide element.

For example, the colder side 7 can be supplied with cooling water while the warmer side 8 receives flue gas or the like which flows through the tubes 9. The tubes 9 extend through the tube sheet 2 spaced from one another and from the blind bores 3. The tubes 9 are secured in bores 12 in the tube sheet 2.

The tube 4 extending within the bore projects upwardly beyond the ring 6 as shown in FIG. 1 and has a guiding element extends transversely of the axis of the tube so that the combination of the guiding element and the tube provide a T-shaped flow passage.

Figure 2:
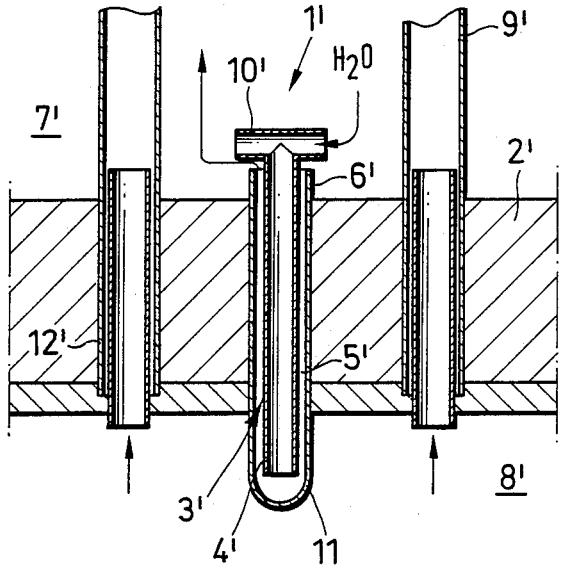

While FIG. 1 shows the length of the bore 3 being less than the thickness of the wall member 2, in FIG. 2 a continuous bore 3' extends through the wall member or tube sheet 2' and is closed by a cap 11 projecting outwardly and downwardly from the warmer side 8' of the wall member.

As can be seen in FIG. 2, the cap 11 can be formed as one end of a sleeve having a length so that it extends from the colder side 7' of the tube sheet 2' and forms a ring 6'. The invention is, of course, not limited to this embodiment. For elements having the same function, the same reference numeral has been used as in FIG. 1, however, with the addition of a prime (').

With reference to FIG. 2, the device embodying the present invention functions as follows:

The colder side 7' is assumed to be charged with water and the warmer side 8' with cooled hot gas at a temperature is still above the vaporization temperature of water at the prevailing pressure. The gas on the warmer side 8' passes over the cap 11 and heats the water flowing downwardly through the tube 4' into the annular space 5' between the tube and the bore 3' so that the water is vaporized and flows upwardly through the annular space as water vapor. The vaporization produces a suction effect so that more water from the cold side 7' enters the tube 4' and undergoes vaporization in cap 11 or along the bore wall surface of the tube sheet 2' and exits from the bore in the form of water vapor. Accordingly, a "natural circulation" of the cooling water is obtained in the device 1'. The function of the embodiment in FIG. 1 is, of course, the same. The ring 6 and the guiding element 10 are provided for better separation of the water vapor and the water. The hot gas flows from the warmer side through the tubes 9'. The tubes, 9' extend through bores 12' in the tube sheet 2'.

Figure 3:
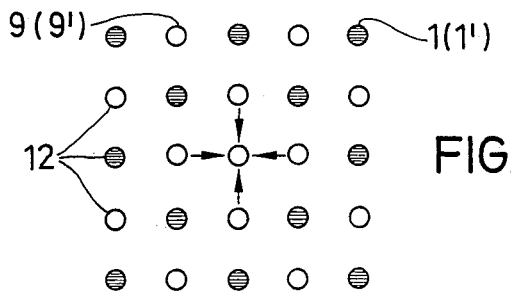
FIGS. 3 to 5 illustrate typical arrangements of the cooling devices positioned in a tube sheet.
Figure 4:
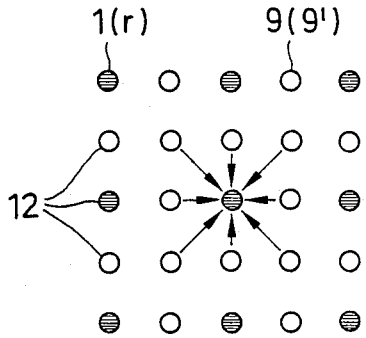
Figure 5:
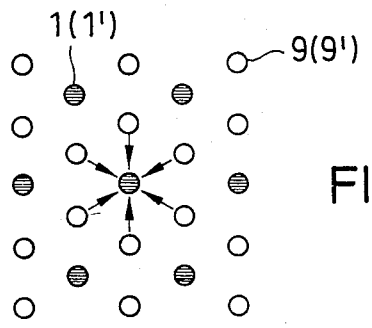

In FIGS. 3 to 5, typical arrangements of the cooling devices 1 and 1' are displayed. A portion of the bores 12 have been formed as blind bores or as closed bores according to FIGS. 1 and 2 and may be equipped with a device incorporating the present invention.

The above-described embodiments of the present invention may, of course, be changed in many respects without departing from the basic concept of the invention. Thus, the invention is not limited to any particular design of the wall member, as can be noted in FIG. 2. Coating as a protection against aggressive fluids or a special design of the hot-gas-carrying tubes may also be provided. The caps 11 projecting downwardly on the warmer side 8' which contains a generally aggressive gas which is to be cooled, may be provided with a special coating. Blind bores as shown in FIG. 1 may alternate with the closed bores as set forth in FIG. 2. Even the special design of the water and water vapor guiding elements may be varied provided that the water vapor leaving the device does not interfere with the incoming cooling water flow.

While specific embodiments of the invention have been shown and described in detail to illustrate the application of the inventive principles, it will be understood that the invention may be embodied otherwise without departing from such principles.

I claim:

1. Device for cooling thick-walled components supplied on opposite surfaces with different temperature media with the media possibly being at different pressures, such as for use in cooling heat exchanger tube sheets, comprising a horizontally arranged wall member having a first upper surface exposed to a lower temperature vaporizable liquid medium and an oppositely facing second lower surface exposed to a higher temperature fluid medium with said first and second surfaces disposed in spaced relation, a plurality of first tubes extending generally vertically through said wall member from said second lower surface outwardly from said first upper surface for conducting the higher temperature fluid medium through said wall member, a plurality of generally vertically extending bores formed in said wall member in spaced relation to said first tubes and extending from said first upper surface toward said second lower surfaced each said bore having an open end on the first surface side of said wall member and being closed at the opposite end thereof, a generally vertically extending second tube having a smaller diameter than said bore located within and extending in the axial direction of said bore, said second tube having a first end projecting upwardly and outwardly from said first upper surface and a second end located within said bore and spaced from the closed end of said bore, the exterior surface of said second tube and the interior surface of said bore defining an annular flow space extending therebetween so that flow of the liquid medium entering the first end of said second tube is exposed to heating and is vaporized as it flows from the second end of said second tube and flows out through said annular flow space whereby a "natural circulation" of the liquid medium flow can be achieved within said bores.

2. Device, as set forth in claim 1, wherein the length of said bore from said first surface is less than the thickness of said wall member between the first and second surfaces thereof.

3. Device, as set forth in claim 1, wherein said bore extends continuously between said first and second surfaces of said wall member and a cap extends outwardly from said second surface and forms a continuation of said bore and also forms the closed end of said bore.

4. Device, as set forth in claim 1, 2, or 3, wherein a ring is positioned on the first surface of said wall member projecting outwardly therefrom and forming a continuation of said bore in said wall member and said second tube within said bore extends through and projects outwardly from said ring in the direction away from said first surface.

5. Device, as set forth in claim 1, 2 or 3, wherein a first guiding element is formed at the open end of said bore projecting outwardly from the first surface of said wall member and a second guiding element is formed on the end of said second tube projecting outwardly from the first surface of said wall member so that said first and second guiding elements define outlet and inlet openings, respectively, for the flow of a cooling medium through said bore passing first through said second guiding element into said tube then into said annular flow space and finally flowing out of said first guiding element.

* * * * *

UNITED STATES PATENT AND TRADEMARK OFFICE

CERTIFICATE OF CORRECTION

PATENT NO. : 4,869,315

DATED : September 26, 1989

INVENTOR(S) : Paul Mevenkamp

It is certified that error appears in the above-identified patent and that said Letters Patent is hereby corrected as shown below:

On the title page assignee should read

--(73)Assignee: Uhde GmbH, Dortmund, Fed. Rep. of Germany --.

Signed and Sealed this

Ninth Day of October, 1990

*Attest:*

*Attesting Officer*

HARRY F. MANBECK, JR.

*Commissioner of Patents and Trademarks*